US007112238B2

(12) United States Patent
Joannou

(10) Patent No.: US 7,112,238 B2
(45) Date of Patent: Sep. 26, 2006

(54) ELECTRONIC AIR FILTER WITH RESISTIVE SCREEN AND ELECTRONIC MODULAR ASSEMBLY

(76) Inventor: Constantinos J Joannou, 9B Hadley Circle, Nepean, Ontario (CA) K2H 6P1

( * ) Notice: Subject to any disclaimer, the term of this patent is extended or adjusted under 35 U.S.C. 154(b) by 84 days.

(21) Appl. No.: 11/020,162

(22) Filed: Dec. 27, 2004

(65) Prior Publication Data

US 2006/0137527 A1 Jun. 29, 2006

(51) Int. Cl.
*B03C 3/04* (2006.01)
*B03C 3/66* (2006.01)

(52) U.S. Cl. ..... 96/66; 96/80

(58) Field of Classification Search ..... 96/66, 96/80, 81, 96, 98, 99
See application file for complete search history.

(56) References Cited

U.S. PATENT DOCUMENTS

| | | | | | |
|---|---|---|---|---|---|
| 3,073,094 | A * | 1/1963 | Landgraf et al. | ..... | 96/66 |
| 3,626,668 | A * | 12/1971 | Cardiff | ..... | 96/58 |
| 4,549,887 | A | 10/1985 | Joannou | ..... | 96/58 |
| 4,652,988 | A * | 3/1987 | McLain et al. | ..... | 96/81 |
| 4,828,586 | A | 5/1989 | Joannou | ..... | 96/66 |
| 5,108,470 | A * | 4/1992 | Pick | ..... | 96/58 |
| 5,137,552 | A | 8/1992 | Sasaki | ..... | 96/80 |
| 5,364,458 | A * | 11/1994 | Burnett et al. | ..... | 96/55 |
| 5,474,599 | A | 12/1995 | Cheney et al. | ..... | 96/55 |
| 5,518,531 | A * | 5/1996 | Joannu | ..... | 96/55 |
| 5,538,692 | A | 7/1996 | Joannou | ..... | 422/121 |
| 5,573,577 | A | 11/1996 | Joannou | ..... | 96/66 |
| 5,807,425 | A * | 9/1998 | Gibbs | ..... | 96/66 |
| 5,846,302 | A * | 12/1998 | Putro | ..... | 96/66 |
| 5,989,320 | A * | 11/1999 | Rutkowski | ..... | 96/55 |
| 6,077,334 | A | 6/2000 | Joannou | ..... | 96/66 |
| 6,375,714 | B1 * | 4/2002 | Rump et al. | ..... | 95/3 |
| 6,491,743 | B1 | 12/2002 | Joannou et al. | ..... | 96/67 |
| 6,497,754 | B1 | 12/2002 | Joannou | ..... | 96/67 |
| 6,764,533 | B1 * | 7/2004 | Lobiondo, Jr. | ..... | 96/66 |
| 2005/0109204 | A1 * | 5/2005 | Coppom et al. | ..... | 95/15 |

FOREIGN PATENT DOCUMENTS

| | | | | |
|---|---|---|---|---|
| DE | 3420973 | * 12/1985 | ..... | 96/66 |
| JP | 5-261314 | * 10/1993 | ..... | 96/80 |

* cited by examiner

*Primary Examiner*—Richard L. Chiesa
(74) *Attorney, Agent, or Firm*—David J. French

(57) ABSTRACT

A polarized media electronic air filter assembly has an electronics box mounted along one side by a slid-in fit into an open, receiving channel. Arcing between screens is reduced by using a relatively resistive material for at least one of the screens exposed to arcing.

5 Claims, 4 Drawing Sheets

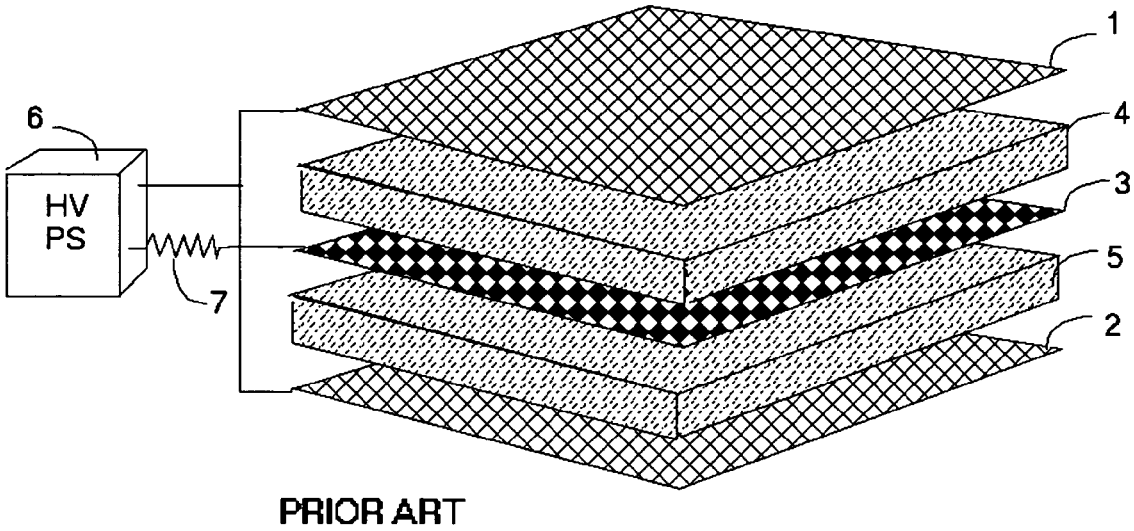
Fig. 1
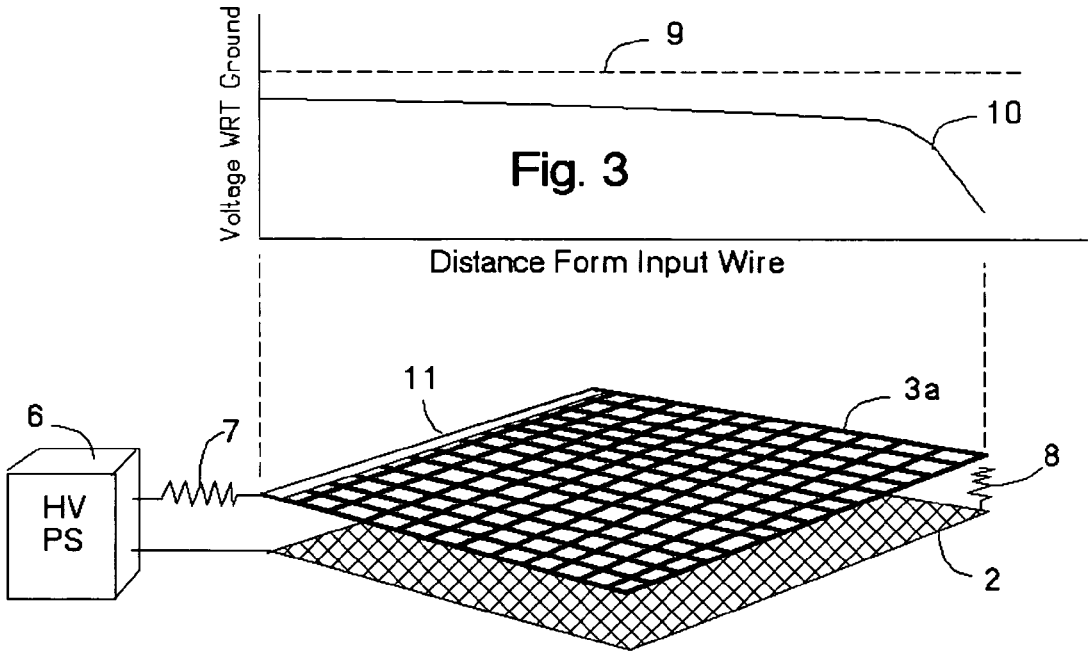
Fig. 3
Fig. 2

Graph showing the increase in efficiency of a filter with resistive inside screen as compared to the same filter using fully conductive metal screen. The resistive screen could accommodate 8.25 KV and the metal screen only 6.25 KV

LEGEND

○ With Resistive Screen

× With Metal Screen

PREVIOUS ART

ELECTRONIC AIR FILTER WITH RESISTIVE SCREEN AND ELECTRONIC MODULAR ASSEMBLY

FIELD OF THE INVENTION

"This invention relates to the field of electronic panel filters. In particular, it relates to features which facilitate the manufacture of such a filter and permit it to operate with higher field potentials."

BACKGROUND TO THE INVENTION

In the previous art, electronic air filters of the charge media type, a filter medium is positioned between metal screens and polarized by applying high voltage between these screens. In many cases, the high voltage supply is an integral part of the filter. Examples are my U.S. Pat. No. 4,549,887 and U.S. Pat. No. 4,828,586. These inventions effectively describe filters which have two outside grounded screens and an inside screen which is charged with high voltage. Between the screens there are pads of dielectric fibrous trapping material which becomes polarized by the electric field between the screens.

These filters are usually one or two inches thick and they get their power from a low voltage supply such as 24 volts which is usually available for the air-handling units. These filters use very little power, about 1½ watts to 2 watts. Their electronic system converts a low voltage input to high voltage, eg, approximately 7 KV to 12 KV. The high voltage creates an electrostatic field inside the filter and polarizes the fibrous media which then better attracts the dust from the air flow. The method of attaching the power supply electronics to the filter itself is one object of this invention.

The amount of voltage which can be applied between these screens is limited by the space between the screens. Typically for a one-inch thick filter, the applied voltage is approximately 7 kilovolts. If the voltage is increased beyond this, avalanche arcing has in the past occurred between the inside screen and the outside grounded screens. This produces a loud sparking noise. Avalanche discharge occurs when a small leakage starts which ionizes the air and generates a conductive path between the screens at one spot. This causes the charge on the inside screen to dissipate abruptly thus making the loud noise. The effect is intense because the inside screen and the outside screens form a capacitor with the dielectric media being the dielectric.

U.S. Pat. No. 5,573,577, by the same inventor, describes a similar filter where conductive strings are used in place of the inside screen. The purpose of using the strings is to provide internal ionization via the loose ends of the fibers. These strings feature loose fiber ends and they are rendered conductive by some means. In this case, avalanche discharge is very minimal because the strings, by their small total surface have very small capacitance. In practice, they are about 1¼ inches apart. The actual area covered by the strings is much smaller as compared to the area covered by an equivalent screen. This is why the strings have very small capacitance.

Another object of my invention is therefore to provide a method of allowing a higher voltage to be employed without the presence of severe avalanche discharge.

By reducing avalanche discharge in these filters and enabling application of higher voltage between the screens, a higher efficiency of the filter is provided.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

"The invention herein is based on providing a charged screen in charged media type filters wherein the screen is made of a resistive material, such as a plastic mesh, which is made to have high resistance to current flow. Thus the charged middle screen of a composite filter assembly as described above is made of resistive material and it is charged by high voltage of the order of 7 to 12 KV with respect to the grounded outer screens. The high resistance nature of the middle screen limits large amounts of current from flowing in cases where leakage gives rise to the formation of an arc. By using a highly resistive screen, the area covered by the screen can be the same as with a metal screen but because of the screen's high resistivity, avalanche discharge is reduced or eliminated. In this way, we get good polarization, because of the large area covered with little or no avalanche discharge."

It has been found that if a charged screen has high resistivity then, upon the commencement of the formation of an arc, a small leakage current passing between the charged screen and the outside grounded screens causes the voltage at the point of the arc to decrease. A voltage drop occurs when current flows through the resistance. ($V=IR$). The presence of resistance prevents a large discharge from being sustained because the voltage across the arc immediately drops.

Another feature arising from the use of a high resistivity screen is that the resistance prevents the innate capacitance of the rest of the screen from providing high current to flow to the discharge site, consequently, by using resistive charged screens, the applied voltage can be increased thus improving the efficiency of the filter. By using a highly resistive screen, the area covered by the screen is the same as with a metal screen but because of the screen's high resistivity, avalanche discharge is eliminated. In this way, we get good polarization, because of the large area covered with no avalanche discharge.

According to a further feature of the invention, the electronics box that contains the high voltage power supply is made to interfit with and act as part of the channel formed along one side of the filter. The channel/box combination collectively acts as an extension to the filter and ensures that the filter unit has the shape of a completed rectangle so that, when it is installed in an air handling unit, it will seal properly directing air to pass only through the filter medium.

The foregoing summarizes the principle features of the invention. The invention may be further understood by the description of the preferred embodiments and drawings which now follow.

BRIEF DESCRIPTION OF THE FIGURES

FIG. 1 is an exploded perspective view of the air filtration elements of a typical prior art charged media type filter before a resistive screen according to the invention is installed, including a central conductive charged screen.

FIG. 2 is an exploded perspective view of only an external screen and the central charged screen of FIG. 1, incorporating a resistive screen according to the invention and depicting a leakage current at the corner of the filter.

FIG. 3 is a graph positioned above the resistive, central screen, showing the voltage distribution across the resistive screen when leakage current occurs.

FIG. 6*b*, present along the side of a filter, shown assembled as FIG. 6*a*.

FIGS. 6*b* and 6*c* depict the shortened channel and modified electronics box respectively.

DESCRIPTION OF THE PREFERRED EMBODIMENT

Figure 4:
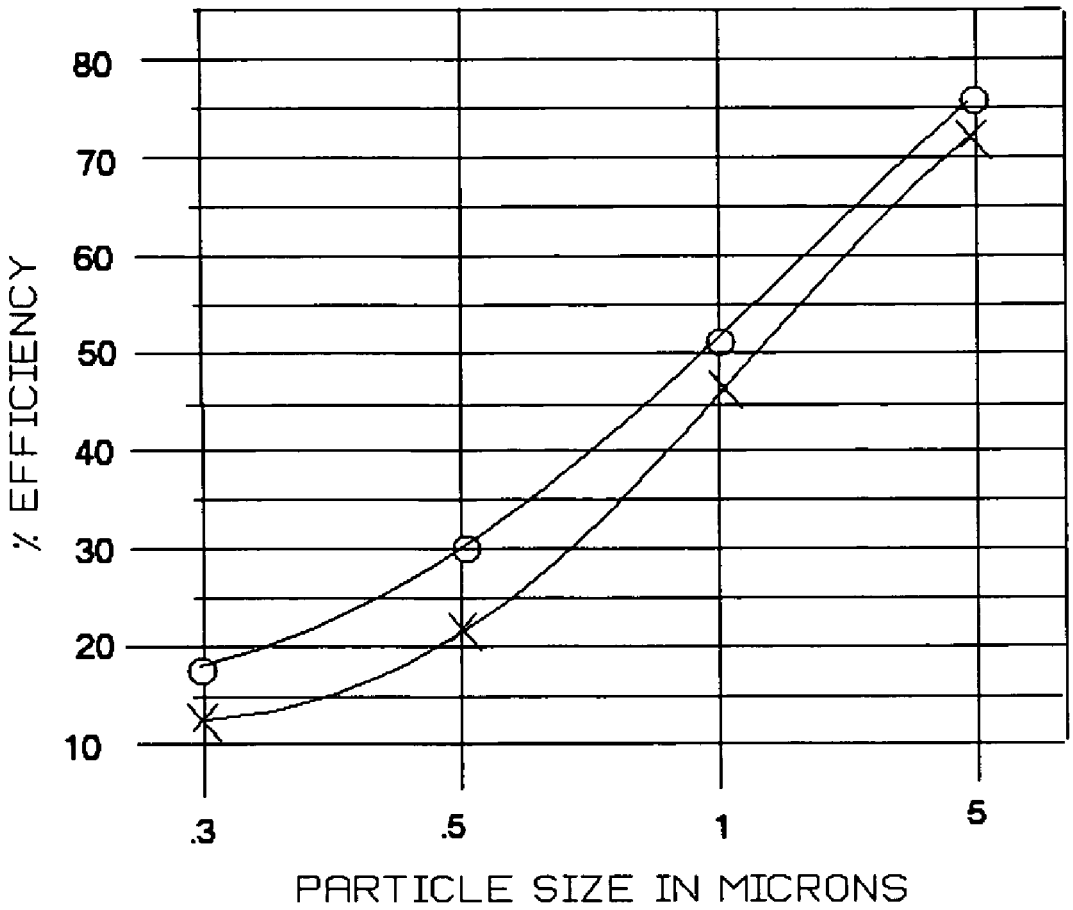
"FIG. 4 is a graph showing the improvement in efficiency of a filter using resistive screen as to one using metal screen due to the permitted operation of the improved screen at 8.25 kilovolts as opposed to 6.25 kilovolts using the metal screen."

FIG. 1 shows a typical arrangement and assembly order of the past designs for trapping media and electrical screens in a charged media type electronic air filter. Outside screens 1 and 2 are electrically grounded. A central screen 3 is charged to high voltage from power supply 6. The high voltage applied between the screens 1 and 2, and between screens 2 and 3, generates an electrostatic field which polarizes the dielectric filter trapping media 4 and 5. The polarization of the trapping media forms positive and negative surface charges on the media fibers, which in turn attract dust.

In the pre-existing charged media filters, the inside screen is made of metal, which acts as a capacitor between the outside screens 1 and 2. If by some reason the media 4 and 5 or the surrounding air becomes leaky and a small amount of current flows between the screens 1, 2, 3, this leakage ionizes the surrounding air which then becomes conducting. As a result, the charge on the central screen 3 starts to flow through the initial path. As more and more current flows, this produces further ionization of the air, contributing to more conduction. Finally, a cascade effect develops and the whole charge on the central screen 3 discharges with a spark. This is what is called "avalanche discharge". It produces an annoying sound, ozone, and momentarily, the electronic features of the air filter ceased to operate.

As a consequence of this phenomenon, the voltage that can be applied to the central screen of a traditional filter is limited to about 7 kV in the case of a one-inch filter. To eliminate the avalanche effect and be able to apply higher voltage to the central screen 3, the central screen can be made of a high resistivity material such as plastic. FIG. 2 shows a central screen 3 a which is made of plastic or the like that has high resistivity with a specific resistance of, on the order of, 20 Megohm-centimeters.

To illustrate the effect of this arrangement, FIG. 2 shows the power supply 6 connected to one end of the high resistivity screen 3*a* via conductive, edge-mounted electrode 11. Electrode 11 continues to distribute high voltage over other portions of the central screen 3*a* when a portion of the resistive central screen 3*a* is subject to leakage current.

FIG. 2 also shows a current leakage 8 occurring between the central screen 3*a* and the external screen 2 of a filter assembly according to the invention. In this case, the moment some leakage occurs, the voltage on the central screen 3*a* around the leakage will drop. Because of the resistance of the central screen 3*a*, the leakage will be minimized. No avalanche discharge can occur because the resistance of the central screen 3*a* limits the flow of current to the leakage point. When, eventually, leakage current ceases to flow, as when a current-supporting chain of dust particles has been disrupted, the central screen 3*a* will re-acquire the full voltage of the power supply 6 across its entire surface.

FIG. 3 is a graph of the voltage distribution along a diagonal line extending across the central screen 3*a* of FIG. 2 between the point where the power supply 6 is connected and the leakage point 8. If there is no leakage, the voltage profile will be constant, that of the power supply 6. This is depicted as curve 9. If a leakage occurs, then the voltage profile will be that of curve 10. Notice that there is a small voltage drop from the supply voltage even at the point of power supply connection. This is the IR drop in the power supply internal resistance 7. At the leakage point 8, the voltage drops much more due to the high resistivity of the central screen 3*a*.

Accordingly, by making the central screen 3*a* with a high resistivity material, we can apply higher charging voltage to the assembly of screens which produces higher degree of polarization which, in turn, increases the filter's efficiency. FIG. 4 shows the increased efficiency that arises by boosting the voltage between screens from 6.25 kilovolts to 8.25 kilovolts.

The graph of FIG. 4 shows results of tests made on otherwise identical filters, one with an inside screen made completely conducting metal mesh and one with a resistive plastic mesh. The metal mesh could accommodate only 6.25 KV before avalanche sparking occurred. The resistive screen could accommodate 8.25 KV. A higher voltage than that would cause excessive discharge but no avalanche sparking occurred. As it can be seen from the test results, the resistive screen has a better overall efficiency due to the higher voltage applied as compared to the filter with the metal screen.

Figures 5A, 5B, 5C:
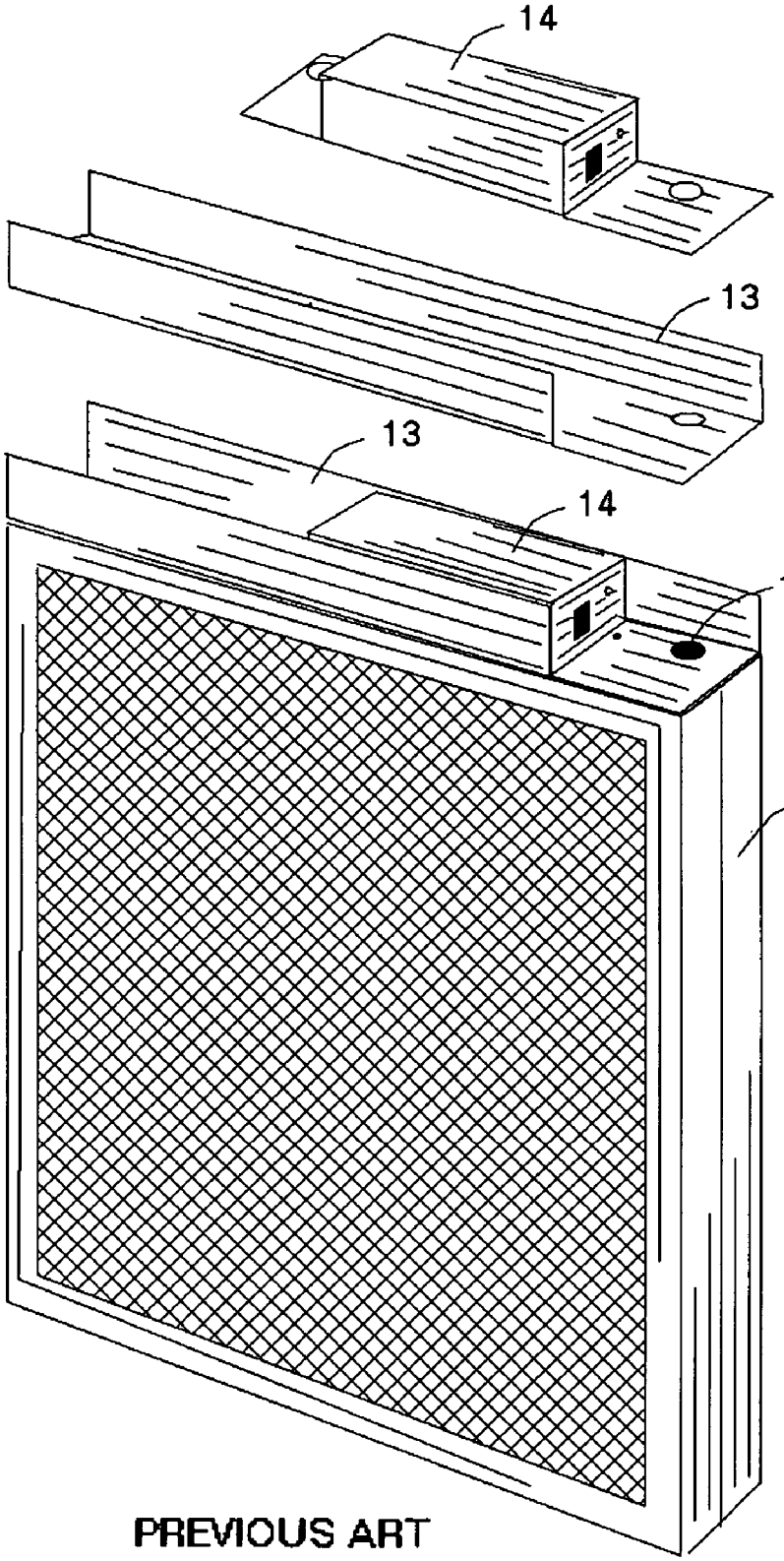
"FIGS. 5*a*, 5*b* and 5*c*, are perspective assembly views showing respectively the filter in its frame, FIG. 5*a*, a channel FIG. 5*b*, and the electronics box, FIG. 5*c*, positioned to indicate how the high voltage electronics box is assembled by being fitted into the channel, according to prior art procedures to provide an assembled filter module."

"Turning to the assembly of the electronic high voltage power supply on the filter, FIGS. 5*a*, 5*b* and 5*c* depict the previous art. FIG. 5*a* shows a complete filter 12 having a channel 13 extending along one whole side of the filter 12. Such channel 13 may preferably be comprised of a plastic material. Channel 13 is riveted or fastened onto the side frame of filter 12. An electronic box 14 which contains the high voltage electronics is located and fastened by fasteners 15 inside the channel 13 as shown in FIG. 5*a*. As can be seen, box 14 has to be narrower than the channel 13 in order to fit inside the channel 13. The channel width is also limited by the width of the filter. Notice also that there is a duplication of walls between the channel and the box around the box area."

Figure 6D:
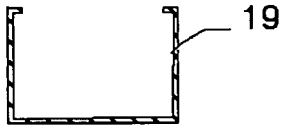
FIG. 6*d* is a cross-sectional view taken through the channel member.
Figure 6E:
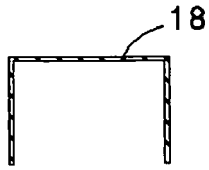
FIG. 6*e* is a cross-sectional view taken through the outer casing of the high voltage electronics box.
Figure 6B:
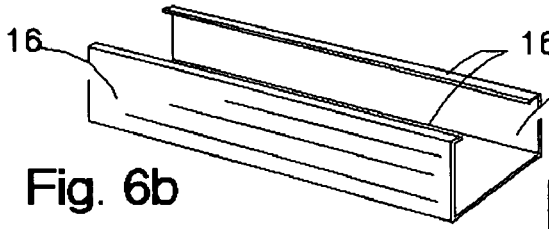
FIGS. 6*a*, 6*b*, and 6*c* are perspective assembly view showing how the high voltage electronic box, FIG. 6*c*, according to the invention, is fitted into a shortened channel.
Figure 6C:
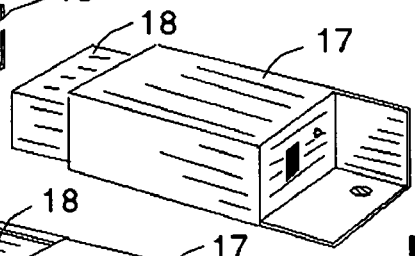
Figure 6A:
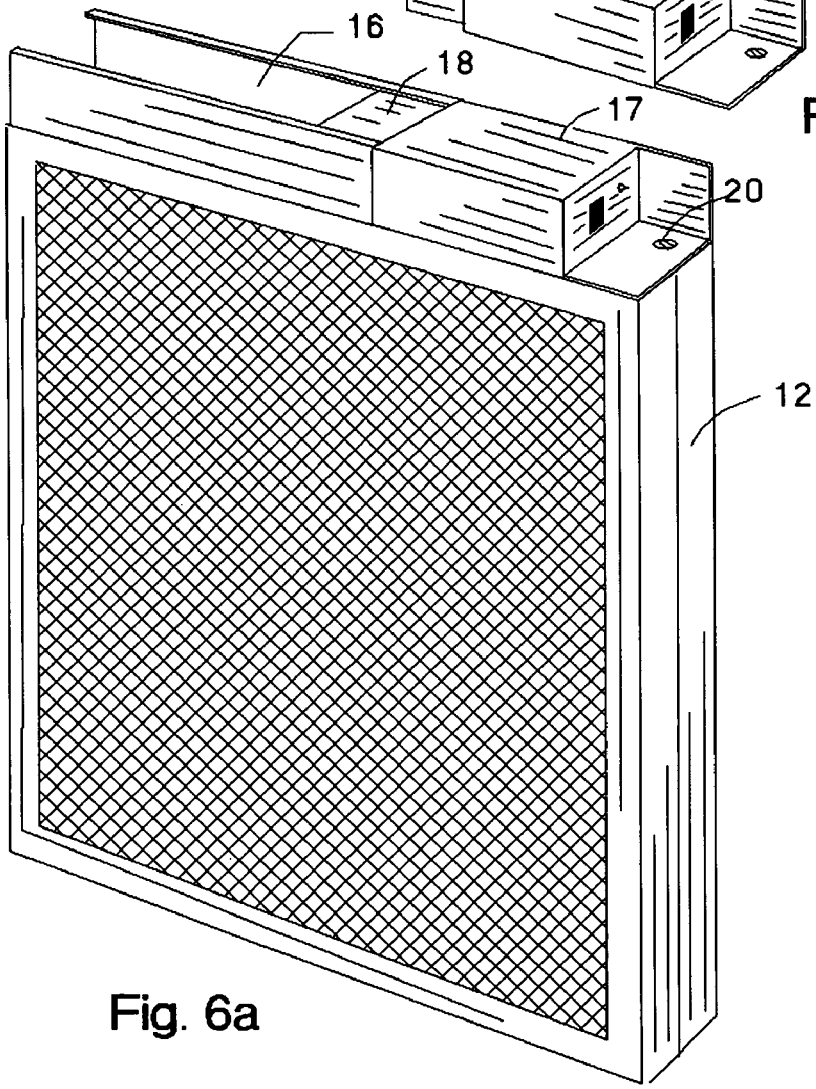

The further improvement of the present invention is shown in FIGS. 6*a*, 6*b*, 6*c*, 6*d* and 6*e*. In FIG. 6*a*, filter 12 has a partial channel 16 mounted along one side, but now covering only part of the filter side. The revised electronics box 17, which is made, preferably of non-conductive plastic material, has a rear portion 18 which is dimensioned to slidingly fit inside the inner volume 19 of channel 16. FIG.

6*d* shows in cross-sectional view the inner volume 19 of channel 16. FIG. 6*e* shows in cross-sectional view protruding portion 18 extending from box 17.

In final assembled format, as shown in FIG. 6*a*, channel 16 first is fastened permanently onto the filter 12. Electronics box 17 is then inserted into the channel by its part 18 engaging within the inner volume 19, trapped by flanges 16*a*. The electronic box is then retained in place by being fastened to the filter only by a single fastener 20. In this way, electronic box 17 can have the same width as the filter, allowing for more space for electronics. Further, it can be installed or removed by undoing only one fastener 20. Additionally, there is no duplication of walls around the box area.

CONCLUSION

The foregoing has constituted a description of specific embodiments showing how the invention may be allied and put in use. These embodiments are only exemplary. The invention in its broadest, and more specific aspects, is further described and define in the claims which now follow.

These claims, and the language used herein, are to be understood in terms of the variants of the invention, which have been described. They are not to be restricted to such variants, but are to be read as covering the full scope of the invention as is implicit with the invention and the disclosure that has been provided herein.

I claim:

1. An electronic air filter comprising:

a) a frame having an electronics-support side;

b) external polarizing screens contained within said frame;

c) polarizable dust-trapping media contained between the external screens;

d) a central screen contained within the external polarizing screens and separated from said external polarizing screens by said dust-trapping media;

e) a channel with an inner volume mounted along said electronics-support side of the frame, said channel not extending the full length of said electronics-support side;

f) a high voltage supply electronics box containing a high voltage power supply having a protruding end portion, wherein said protruding end portion is dimensioned to interfit within the inner volume of the channel so that the channel/box combination collectively acts as an extension to the filter frame, providing the filter with the shape of a completed rectangle so that, when it is installed in an air handling unit, it will seal properly, directing air to pass only through the filter medium.

2. An electronic air filter as claimed in claim 1 wherein said box is made of non-conductive plastic material.

3. An electronic air filter as claimed in claim 2 in which said channel is made of plastic material.

4. An electronic air filter as claimed in claim 1 wherein said central screen has a volume resistivity of at least 20 megohm-centimeters.

5. An electronic air filter as claimed in claim 4 wherein the central screen has a side and said high voltage power supply is connected to said central screen by a conductive electrode extending along said side of the central screen.

* * * * *

UNITED STATES PATENT AND TRADEMARK OFFICE

CERTIFICATE OF CORRECTION

PATENT NO. : 7,112,238 B2
APPLICATION NO. : 11/020162
DATED : September 26, 2006
INVENTOR(S) : Constantinos J. Joannou It is certified that error appears in the above-identified patent and that said Letters Patent is hereby corrected as shown below:

Column 3, line 7 the word --compared-- is to be inserted after the words “screen as”.

Signed and Sealed this

Sixth Day of November, 2007

JON W. DUDAS
*Director of the United States Patent and Trademark Office*